United States Patent [19]

Lat et al.

[11] Patent Number: 4,587,173

[45] Date of Patent: May 6, 1986

[54] METHOD FOR IMPROVING ADHESION OF JOINT COMPOUND TO METAL CORNERBEAD

[75] Inventors: Geronimo E. Lat, Skokie; Terrance L. Williams, Crystal Lake, both of Ill.

[73] Assignee: United States Gypsum Company, Chicago, Ill.

[21] Appl. No.: 603,926

[22] Filed: Apr. 26, 1984

[51] Int. Cl.[4] ..... C23F 11/00

[52] U.S. Cl. ..... 428/457; 428/460; 428/703; 52/741

[58] Field of Search ..... 428/457, 460, 703; 52/741

[56] References Cited

U.S. PATENT DOCUMENTS

| | | | |
|---|---|---|---|
| 2,901,377 | 8/1959 | Bode | 428/703 X |
| 3,008,914 | 11/1961 | Fry | 428/460 X |
| 3,821,145 | 6/1974 | Walus | 428/460 X |
| 4,190,693 | 2/1980 | Martorano et al. | 428/460 X |

FOREIGN PATENT DOCUMENTS

| | | | |
|---|---|---|---|
| 54718 | 5/1977 | Japan | 428/703 |
| 112985 | 10/1978 | Japan | 428/460 |
| 126225 | 10/1979 | Japan | 428/703 |
| 22685 | 3/1981 | Japan | 428/703 |

*Primary Examiner*—George F. Lesmes
*Assistant Examiner*—Nancy A. B. Swisher
*Attorney, Agent, or Firm*—Robert M. Didrick; Samuel Kurlandsky; Robert H. Robinson

[57] ABSTRACT

Metal cornerbead for drywall partitions is coated with a water reducible acrylic resin to improve the adhesion of joint compound to it. Aqueous solution of resin may be added to roll-forming lubricant such as hexylene glycol.

6 Claims, No Drawings

METHOD FOR IMPROVING ADHESION OF JOINT COMPOUND TO METAL CORNERBEAD

This invention relates to the covering of metal cornerbeads on plasterboard walls with a joint compound. More particularly, it relates to improving the adhesion between the cornerbead and the joint compound.

In the process of constructing walls and ceilings from gypsum wallboard, galvanized steel cornerbeads are used to reinforce the outside corners. The cornerbeads are covered with a setting- or non-setting type of joint compound. Considerable difficulty has been experienced, however, in obtaining satisfactory adhesion between the dried joint compound and the surface of the galvanized steel.

Adhesion has been improved somewhat by adding a binder such as polyvinyl alcohol, starch, or polyvinyl acetate to the joint compound. The increase is not sufficient, however, and the rather large amounts of such binders used cause the joint compound to be so hard that sanding to a smooth surface is difficult. Moreover, the cost of the joint compound is increased.

Another way to improve the adhesion has been the high temperature galvanization of the steel wherein an alloy of zinc and steel is formed on the surface. Cornerbead made from such steel is expensive and not readily available.

U.S. Pat. No. 4,419,853 teaches the application of a thin film of an aziridine to the metal during the forming of the cornerbead. The aziridine is dissolved in a forming lubricant such as hexylene glycol. Excellent adhesion of a joint compound to the treated cornerbead is achieved. The aziridine, however, tends to accumulate on the forming rolls in the form of a gum. Still another solution to the adhesion problem is needed.

It is accordingly an object of the present invention to provide a method for improving the adhesion between the surface of metal, particularly for use as a cornerbead, and a cementitious composition such as a joint compound.

It is a further object to provide a method which does not require an additional step for processing the metal structure.

It is still an additional object to provide a composition which may be applied to a metal as it is being formed into a cornerbead structure, which improves the adhesion of the metal to a joint compound applied thereto.

It is a further object of this invention to provide a cornerbead having improved adhesion to a joint compound.

It is yet another object of this invention to provide a method for improving the adhesion of a metal cornerbead to joint compound which is relatively less hazardous to the operator and which does not foul the metal forming apparatus during fabrication of the cornerbead.

Other objects and advantages of the invention will become apparent upon reference to the following description.

The objects of this invention are achieved by applying a thin film of an acrylic resin to the metal before or after the cornerbead is formed. An aqueous solution of the resin may be sprayed, roller-coated or brushed as such onto the metal or the solution may be added to a lubricant used for the roll-forming of the cornerbead. The dried resin is water wettable. Thus, the water present in the joint compound partially solvates the resin on the surface of the metal and a bond is formed between the resin and the solids of the joint compound. The result is a greatly improved adhesion of joint compound to the metal.

The resin is a water reducible or water solubilizable acrylic copolymer. Functional monomers such as acrylic and methacrylic acid, itaconic acid, maleic anhydride, dimethylaminoethyl acrylate, t-butylaminoethyl methacrylate, diethylaminoethyl acrylate, 2-vinyl pyridine, methacrylamide, acrylamide, hydroxypropyl methacrylate, hydroxyethyl acrylate, and the like are polymerized along with the lower alkyl acrylates and methacrylates. The lower alkyl groups usually have from one to four carbon atoms. In either case, the copolymer contains a sufficient proportion of the acidic or basic groups to render it soluble in water when the pH is adjusted and a water miscible polar co-solvent is added. The water reducible copolymer is prepared in a water miscible solvent by conventional polymerization techniques. Its molecular weight is in the range of 20,000 to 50,000. It is a true solution polymer when in its salt form. The water solubilizable copolymer is prepared by emulsion polymerization techniques designed to produce colloidal particles. Its molecular weight ranges from 20,000 to 200,000. The acrylic resin useful in this invention is exemplified by three sold under the Acrysol trademark by Rohm and Haas, I-62, I-98, and I-100. The Acrysol I-100 resin is a clear to slightly hazy solution having a viscosity of 300 cps. The solvents are water and isopropanol and the copolymer is solubilized with ammonia. The other two are colloidal dispersions to which ammonia or an amine must be added for solubilization.

Hexylene glycol is the preferred roll-forming lubricant. Other glycols such as ethylene glycol, diethylene glycol, propylene glycol and the like are also useful in this invention. As modified for the purposes of this invention, the lubricant contains from about 2.0% to about 8.5% by weight of the acrylic resin solids.

In Examples 1–4, various amounts of the Acrysol I-100 resin solution (37% solids, pH 8.1) were mixed with 100 parts by weight of hexylene glycol and the resulting solutions were wiped onto strips of galvanized steel. After the strips were dried, a layer of an all purpose, ready-mixed joint compound of the drying type was placed on each strip and allowed to dry. The degree of adhesion of the joint compound to each strip was determined by scraping it with a knife. The parts by weight of the acrylic resin solids are given in Table I along with the test results for each treated strip and a control strip which had been wiped with hexylene glycol only.

TABLE I

| Example | Weight of resin (%) | Adhesion |
|---|---|---|
| 1 | 2.6 | Very Good |
| 2 | 3.4 | Excellent |
| 3 | 6.2 | Excellent |
| 4 | 8.5 | Excellent |
| Control | 0 | Fair |

In order to determine whether the film of acrylic resin would cause the cornerbeads to stick together when stacked for storage and shipping, six sets of three galvanized steel cornerbeads were coated with a 3.4% by weight solution of the Acrysol I-100 resin solids in hexylene glycol. Each set was stacked together and dried at different conditions of temperature and humidity ranging from about 40° F. to about 120° F. and from about 5% to about 90% R.H. Only a slight amount of sticking was observed in a stack dried in a 120° F. oven and less than that in a 90° F. oven. No sticking occurred under the other conditions, even at 90° F. and 90% R.H. Similar results were observed when cornerbeads were coated with a 6.2% solution of the same resin in hexylene glycol.

In Examples 5 and 6, ethylene glycol was used as the lubricant. Acrysol I-62 resin (50% solids) was used in Example 5 and Acrysol I-98 resin (30% solids) was used in Example 6. Ammonium hydroxide (37% aqueous solution), in an amount equal to about 7% of the weight of the resin, was added in each case to solubilize the resin. The general procedure of Examples 1–4 was followed otherwise and the results are given in Table II wherein the weight of resin is based on the solids content.

TABLE II

| Example | Weight of Resin (%) | Adhesion |
|---|---|---|
| 5 | 3.5 | Very Good |
| 6 | 2.1 | Very Good |

The acrylic resin promotes the adhesion of many cementitious products to the treated metal. Setting type joint compounds, which consist essentially of calcium sulfate hemihydrate, as well as the aforementioned drying type may be used in conjunction with the acrylic resin coated cornerbeads of this invention. The drying type joint compounds contain fillers such as calcium carbonate and gypsum, a binder such as polyvinyl acetate and starch, and a material such as attapulgus clay.

The composition and method of this invention provide a means for improving the adhesion of joint compounds to cornerbeads and other metal adjuncts in a wall and are advantageous over the aziridine treatment in two principal ways. The acrylic resin is less hazardous to handle and the resin does not foul the roll forming apparatus when applied in the form of a solution in the lubricant.

It will be understood that this invention is not limited to the specific details of construction, operation, materials or compositions shown and described hereinabove.

The subject matter claimed is:

1. In the method for covering a metal cornerbead on a plasterboard wall with a joint compound, the improvement which consists essentially of applying an aqueous solution of a water reducible or water solubilizable acrylic resin to the metal to form a film which improves the adherence of the joint compound to the metal.

2. The method of claim 1 characterized further in that the aqueous acrylic resin is dissolved in a lubricant for forming the cornerbead.

3. The method of claim 2 characterized further in that the solution of acrylic resin in the lubricant is utilized during the forming of the cornerbead.

4. The method of claim 2 wherein the solution of the acrylic resin contains ammonia and has a resin solids content of from about 2.0% to about 8.5% by weight.

5. The method of claim 4 wherein the solution contains hexylene glycol.

6. A metal cornerbead having a film consisting essentially of a water-wettable acrylic resin and a tightly adhering layer of a joint compound on its surface.

* * * * *